United States Patent [19]

Ludtke

[11] Patent Number: 4,514,708

[45] Date of Patent: Apr. 30, 1985

[54] QUICK DISCONNECT WAVEGUIDE LOCKING MECHANISM

[75] Inventor: Gerald W. Ludtke, Hoffman Estates, Ill.

[73] Assignee: Motorola, Inc., Schaumburg, Ill.

[21] Appl. No.: 352,629

[22] Filed: Feb. 26, 1982

[51] Int. Cl.[3] ..... H01P 1/00

[52] U.S. Cl. ..... 333/255; 339/75 MP; 403/321; 403/374; 292/240

[58] Field of Search ..... 333/255, 256, 254, 252, 333/248, 260; 403/369, 373, 374, DIG. 4, 321, 322, 343, 361; 292/213, 218, 240, 241; 339/75 M, 75 MP, 238, 273 R

[56] References Cited

FOREIGN PATENT DOCUMENTS

| | | | |
|---|---|---|---|
| 0033072 | 8/1981 | European Pat. Off. | 403/374 |
| 2002350 | 7/1971 | Fed. Rep. of Germany | 339/75 MP |
| 2607253 | 8/1977 | Fed. Rep. of Germany | 333/254 |

*Primary Examiner*—Paul L. Gensler
*Assistant Examiner*—Benny Lee
*Attorney, Agent, or Firm*—Joan Pennington; Edward M. Roney; James W. Gillman

[57] ABSTRACT

The invention is a mechanism for holding a waveguide assembly and a down converter module in locked force multiplied engagement within a transceiver housing. The mechanism includes a lever arm which pivots about a first end which is secured to a bracket. The bracket in turn is secured to the transceiver housing. A knob which includes a locking structure is coupled to the second end of the lever arm. The locking structure is retained in a channel in the transceiver housing. The channel allows the locking structure to move within the channel between a first and second position. There is a camming surface on the lever arm that is more proximate to the first end of the lever arm than to the second end of the lever arm. An aligning pin is mounted on said first assembly in a location so as to engage the lever arm camming surface when the locking structure is physically moved along the transceiver housing channel from a first position to a second position. Movement of the locking structure from the first position to the second position causes the aligning pin to force the down converter module into a force multiplied engagement with the waveguide assembly.

4 Claims, 8 Drawing Figures

$L_1 = 1.162$ $L_2 = 10.669$

DESIRED $F_1 = 100$ lb $$F_2 = \frac{F_1 \times L_1}{L_2} = \frac{100 \times 1.162}{10.430} = 11.14 \text{ lb}$$

QUICK DISCONNECT WAVEGUIDE LOCKING MECHANISM

Background of the Invention

This invention relates to quick release interconnection mechanisms and more particularly to a quick release interconnection mechanism for electrically and mechanically mating a waveguide assembly with a down converter module.

Many mechanical mating mechanisms have been used for connecting a down converter module to a waveguide assembly in a radio transceiver housing. Traditionally, the waveguide assembly and down converter module have been bolted together by screws or bolts and nuts. Since the waveguide assembly and down converter module are usually in a physical arrangement such that the down converter module is in the front portion of the radio transceiver housing and the waveguide assembly in the back portion of the housing, there usually is required at least limited access to the back of the radio transceiver housing in order to unbolt the down converter module from the radio transceiver housing when servicing is required. To accommodate this requirement the radio transceiver housing is usually bolted an appropriate distance away from any nearby wall so as to allow walking access to the back of the radio housing. This arrangement results in the radio transceiver housing consuming much more space than its actual volume and thus considerally reduces the usable floor space available in the vicinity of the radio.

Most transceiver assemblies are designed to take up a minimum amount of space. With a transceiver design requiring back access there is a substantial increase in the effective floor space occupied by the transceiver which thereby mitigates the effort made to design a transceiver of minimum size. The alternative is to place the radio transceiver flush against the nearby wall. This alternative eliminates the extra floor space consumption of the transceiver housing but makes servicing of the radio, and in particular the down converter module, very difficult since the back of the housing cannot be reached without moving the transceiver away from the wall. It then becomes necessary to shut down the transceiver before moving it away from the wall in order to disconnect the down converter module for servicing.

Several alternative connecting mechanisms have been tried in an attempt to overcome the problem of accessability to the down converter module. One solution is to connect the waveguide assembly and down converter module by way of coax cabling. The flexable coax cabling allows for easier connecting and disconnecting of the down converter module from the waveguide assembly but unfortunately it introduces an insertion loss that can be significantly greater than the amount of insertion loss experienced from a direct connection between the down converter module and the waveguide assembly.

It is also known that attempts have been made to provide front access of the down converter module by forming bore holes that are the length of the down converter module and inserting screws that terminate at the waveguide assembly, thus mating the down converter module with the waveguide assembly . The screw needs to be longer than the length of the down converter module in order for it to fit through the bore hole and fasten to the waveguide assembly. Such a screw is cumbersomely long and consequently very difficult to correctly thread. In attempting to fasten the down converter module to the waveguide assembly in this manner, problems develop in improperly joining the screw with the threads in the waveguide assembly and/or the improper mating of the waveguide assembly with the down converter module because of over tightening on one screw causing the jamming of another screw or its improper fit.

Consequently there is a need for a locking mechanism between a down converter module and a waveguide assembly which allows for front panel accessability, quick connect and disconnect, uniform clamping force, low insertion loss and inexpensive but reliable construction.

The object of this invention is to provide a new and improved construction for locking a down converter module to a waveguide assembly wherein the locking mechanism can be both locked and unlocked from the front portion of the radio panel while maintaining a uniform clamping force between the down converter module and the wave guide assembly which allows for a blind connection that is reliable and requires no inspection.

SUMMARY OF THE INVENTION

The invention is a mechanism for holding a first and second assembly in locked engagement within a housing. The mechanism includes a lever arm having a first and second end and mounted at its first end to a bracket which is secured to the housing. A knob which includes a locking structure is coupled to the second end of the lever arm. The locking structure is retained in a channel in the housing. The channel allows the locking structure to move within the channel between a first position and a second position. There is a camming surface on the lever arm that is more proximate to the first end of the lever arm than to the second end of the lever arm. An aligning pin is mounted on said first assembly in a location so as to engage the lever arm camming surface when the locking structure is physically moved along the housing channel from a disengaged position to a engaged position. Movement of the locking structure from the disengaged position to the engaged position causes the aligning pin to force the first assembly into a force multiplied engagement with the second assembly.

Preferably the invention holds a down converter module and a waveguide assembly in locked engagement within a radio transceiver housing. The locking mechanism includes a first and second lever arm, each of which have a camm-ing surface that interacts with aligning pins mounted on the down converter. Movement of the first lever arm causes the second lever arm to follow since a pivot shaft holds the two arms in a fixed relationship. By moving the locking structure from its disengaged to its engaged position the camming surfaces on the first and second lever arm contact the aligning pins and cause the down converter to be pressed into a mating portion of the waveguide assembly. The locking structure holds the down converter module and waveguide assembly together.

The locking structure comprises two cylindrical neck portions. They are positioned one on top of the other with a common axis. The diameter of the first cylindrical neck portion is less than the width of the main portion of the housing channel. Therefore, with the first cylindrical neck portion of the locking structure occupying the housing channel, the locking structure is free to move from its disengaged position to its engaged position. The diameter of the second cylindrical neck portion is greater than the width of the main portion of the housing channel, but it is less than the width of the housing channel at its top and bottom end. Flexiblity along the length of the lever arm allows the locking structure's second cylindrical neck portion to be pushed through the channel opening at the channel top or bottom thus preventing movement of the locking structure from one position to another since the diameter of the second cylindrical neck portion is greater than the width of the main portion of the housing channel.

DETAILED DESCRIPTION OF THE PREFERRED EMBODIMENT

To properly join a waveguide assembly and down converter module together in a direct link it has been common practice to bolt or screw the two assemblies together with a conductive gasket between them. To ensure good electrical continuity between the waveguide assembly and the down converter module, it is desirable to create approximately a 100 pound force at the gasket by tightening the bolts or screws holding the two the two assemblies in place. Such a force assures a good microwave connection. Creating a 100 pound force at the gasket and simultaneously allowing for front end servicing has not been possible in the past. The invention ensures good electrical continuity by way of a reliable connecting scheme that gives a reliable 100 pound force at the gasket while maintaining front end connect-disconnect. Moreover, the connecting and disconnecting is quick and not subject to the usual performance problems of screw and bolts (i.e., overtightening, stripping of threads . . . etc.).

Figures 1A, 1B:
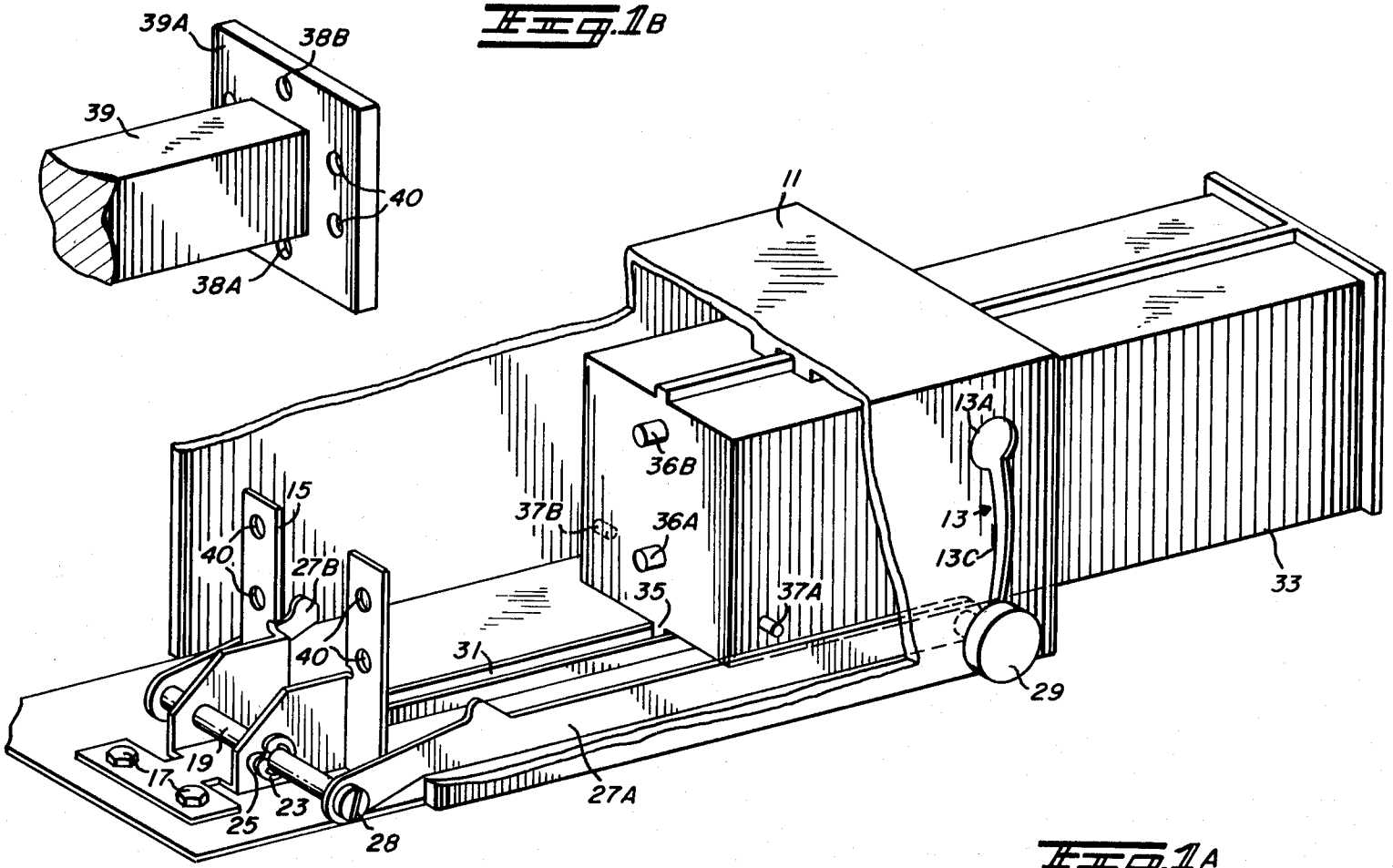
FIG. 1A is a perspective view of the quick release interconnection mechanism according to the invention.
FIG. 1B is a perspective view of the waveguide assembly which mates with the interconnection mechanism of FIG. 1A.

FIG. 1A shows a perspective view of the locking mechanism of the invention. The locking mechanism is mounted on a portion of a radio transceiver housing 11 in FIG. 1. A slot or channel 13 is cut into the side wall of the housing 11. This slot or channel 13 cooperates with the locking mechanism in a manner that will be described later. The locking mechanism itself consists of three primary parts. First there is a support bracket 15 which is secured to the floor of the transceiver housing 11 by means of screws 17 or any other appropriate fastening means. A support shaft 19 is held in place by the bracket 15 through holes in bracket 15. Nylon bushings can be inserted into the holes of bracket 15 and the shaft 19 fitted into the two holes of bracket 15 to allow for the easy rotation of the shaft 19 within the holes. To prevent side to side movement of the shaft 19, E-ring 23 is mounted on a groove 25 in the shaft 19 adjacent to the first hole in bracket 15. A second E-ring is placed in a second groove in shaft 19 adjacent to the second hole of bracket 15 in a manner identical to the mounting and placement of E-ring 23 (the second E-ring is not shown in FIG. 1).

Mounted on the ends of shaft 19 are lever arms 27A and 27B which pivot about the axis of shaft 19. At its axial ends, the cylindrical shaft 19 is flattened at some point on its circumference. In a similar manner the holes in lever arms 27A and 27B which mate with the shaft 19 have flats in such a manner that they mate with the flattened ends of shaft 19. At both axial ends of shaft 19 there is a threaded hole into which a screw 28 is fitted. They serve to hold the lever arms 27A and 27B in place on shaft 19. The flat surfaces at the axial ends of shaft 19 and the flat surfaces within the mating lever arm holes keep the shaft 19 and the lever arms 27A and 27B stationary relative to one another. A knob 29 is attached at the opposite end of lever arm 27A. The knob 29 protrudes through the t-ransceiver housing 11 by way of channel 13. Channel 13 is a arc of a circle with the axis of shaft 19 the circle center. Knob 29 travels along the channel 13 and comes to rest at the top or the bottom of channel 13. Aligning pins 37A and 37B protrude from a first and second surface respectively of down converter module 33. They interact with lever arms 27A and 27B to force the down converter module 33 in proper contact with the waveguide assembly as will be explained in greater detail in connection with FIG. 2. The knob 29 locks into the top of channel 13 to hold the waveguide assembly and down converter module in forced engagement as will be explained more fully in connection with FIGS. 3A–3D. A U-shaped guide 31 is formed along the bottom portion of the housing 11. A mating rail for the guide 31 is formed in the down converter module 33. That mating rail 35 serves to guide the down converter module 33 along the U-shaped guide 31 as it is pushed into the housing 11 through the front portion of the transceiver housing 11. It should be noted that to prevent wobbling of the down converter module as it slides along guide 31 it is desirable to break the guide 31 and its mating rail 35 into two sections that are linearly offset from one another.

Figure 2:
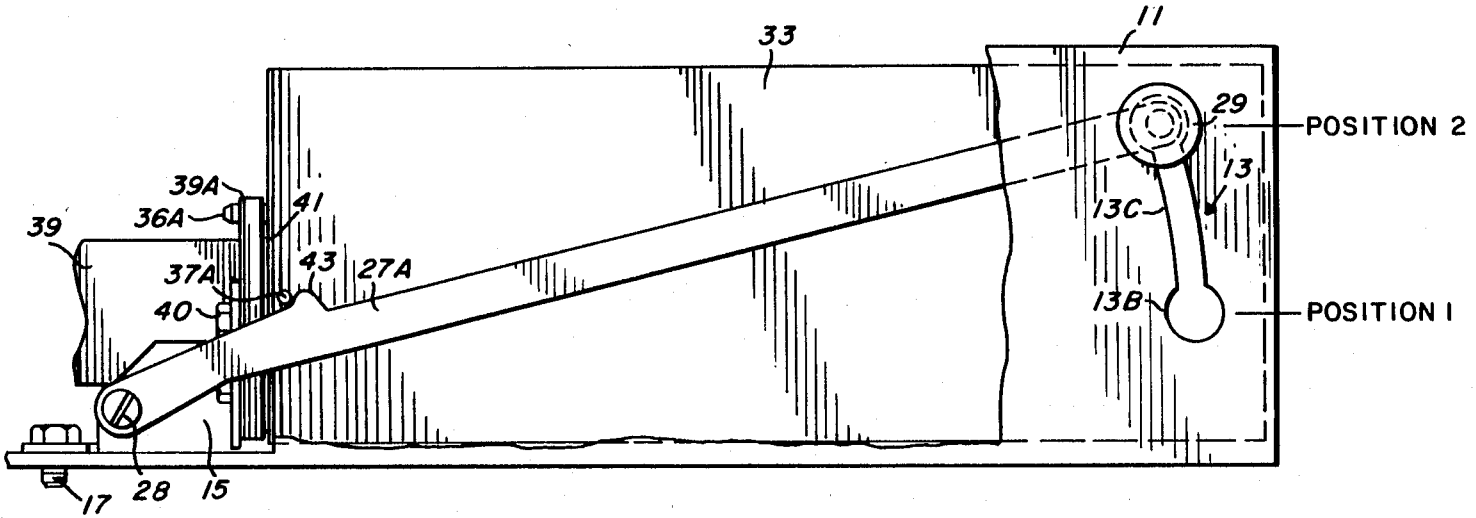
FIG. 2 is a side view of the quick release interconnection mechanism according to the invention.

FIG. 1B shows a perspective view of a waveguide assembly 39 which mates with the down converter module 33 of FIG. 1A. In FIG. 1A, two projections 36A and 36B are integral with a third surface of the down converter module 33. The projections 36A and 36B engage receiving holes 38A and 38B in a flange section 39A of waveguide assembly 39 when the down converter module 33 and waveguide assembly 39 are fully engaged in the transceiver housing 11. Holes 40 in the waveguide flange 39A align with holes 40 in the bracket 15 when the waveguide is fitted to the locking mechanism. (Placement of the waveguide assembly in relation with the locking mechanism is shown in FIG. 2). The waveguide assembly 39 is bolted to the locking mechanism by way of aligning holes 40.

FIG. 2 is a side view of the locking mechanism holding the waveguide assembly and down converter module in locked engagement. FIG. 2 more clearly shows how the aligning pins 37A and 37B interact with the lever arms 27A and 27B. The waveguide assembly 39 to which the down converter module 33 is to be electrically and mechanically connected is positioned on the support bracket 15 as shown in FIG. 2. As explained in connection with FIG. 1B, the waveguide assembly is bolted to the support bracket 15 by bolts through holes 40. As can be seen from FIG. 2, after the down converter module 33 has been moved by hand into a position flush with the waveguide assembly 39, the aligning pin 37A and the lever arm 27A are in a proximate position which allows them to interact upon the lifting of the lever arm from position 1 to position 2 (shown in FIG. 2). Similarly aligning pin 37B and lever arm 27B interact upon the movement of lever arm 27A from position 1 to position 2 since shaft 19 holds the two lever arms in a fixed relationship. Position 1 is a disengaged position while position 2 is a fully engaged position of the locking mechanism.

The flange section 39A of the waveguide assembly 39 is secured to the down converter module side of the support bracket 15. On the face of this flange 39A there is a conductive gasket 41 which both electrically and mechanically seals the interface between the waveguide assembly 39A and the down converter module 33. In order to effectively provide a mechanical connection between the wave guide assembly 39 and the down converter module 33 by way of the conductive gasket 41, it has proven necessary to apply approximately a 100 pound force to the interface. As can easily be seen by the drawing in FIG. 2, the lever arm 27A is a force multiplying arm. A camming surface 43, which is part of of lever arm 27A, directly interacts with aligning pin 37A to create the force multiplying effect. In order to create the force multipling effect the camming surface 43 is located on arm 27A at a point more proximate to the pivot end of the lever arm 27(A) (the end attached to shaft 19) than to the end attached to knob 29 (where the force is applied). As the lever arm 27A is moved from position 1 to position 2, the camming surface 43 engages the aligning pin 37A and cams the aligning pin 37A into the position shown in FIG. 2 when the lever arm has reached position 2. Since lever arm 27A is connected to lever arm 27B through shaft 19, exactly the same interaction is simultaneously occurring with lever arm 27B and its associated camming surface and aligning pin 37B (lever arm 27B and its camming surface are not shown in FIG. 2).

The positioning of the lever arm 27 in position 2 and the location of the aligning pin 37A on the down converter module 33 is such that for pin 37A to be in its position shown in FIG. 2 requires 100 pounds of force exerted by the down converter module 33 thru conductive gasket 41 onto the waveguide assembly flange 39A of wave guide 39. Since lever arm 27A is a force multiplying arm, a human force applied to knob 29 from position 1 toward position 2 requires only a fraction of the 100 pound force that needs to be applied to the down converter-waveguide interface for a proper interconnection.

Figure 3B:
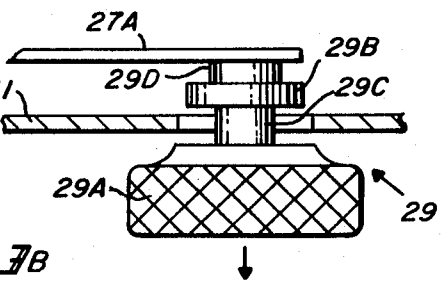
FIGS. 3A–3C are cross-sectional views of the lever arm knob of the quick release interconnection mechanism according to the invention.
Figure 3A:
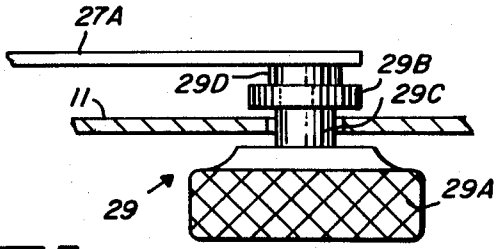
Figure 3C:
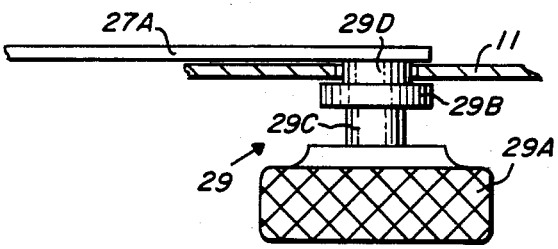

FIG. 3*a* shows a side view of knob 29 of lever arm 27A. The knob 29 interacts with the channel 13 to lock the lever arm 27A in either position 1 or position 2. An outer portion 29A of knob 29 functions as a means for gripping and moving lever arm 27A from position 1 to position 2 or vice-versa. A disk-like portion 29B of knob 29 is shaped like a squat cylinder and is connected to the outer knob 29A by means of a first neck portion 29C of cylindrical shape. The disk-like portion 29B is in turn connected to the lever arm 27A by a second cylindrical neck portion 29D. The second neck portion 29D is of a larger diameter than the first neck portion 29C. Both the first and second neck portions 29C, 29D and disk-like portion 29B have a common cylindrical axis.

Figure 3D:
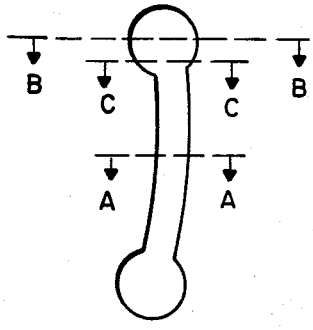
FIG. 3D is a representation of the position of the lever arm knob in FIGS. 3A–3C.

The lever arm 27A is slightly flexible along its length and therefore allows the knob 29 attached to the end of lever arm 27A to be moved slightly in a direction parallel to the axis of the cylinder shapes of first and second neck portions 29C, 29D and disk-like portion 29B. As can be seen in FIG. 3*b*, the disk-like portion 29B of knob 29 is of approximately the same circumference as the rounded top 13A and bottom 13B of channel 13 (channel bottom 13B can be see in FIG. 2). As such, the disk-like portion 29B of knob 29 can be moved from the inside of transceiver housing 11 to outside transceiver housing 11 at either the bottom and top of channel 13 (position 1 or 2). With the disk-like portion 29B of knob 29 pulled to the outer side of the transceiver housing 11, the second neck portion 29D now rests in the channel 13. With the second neck portion 29D in the channel 13, the lever arm 27A cannot be moved from its top or bottom end position since the diameter of the second neck portion 29D is larger than that of the main portion 13C of channel 13. Therefore, the lever arm of 27A is locked into either position 1 or position 2. The disk-like portion 29B cannot be pulled back thru the rounded top 13A or bottom 13B of channel 13 without an upward movement to center the disk-like portion 29B with the rounded ends 13A or 13B of channel 13. This can be more easily seen when FIG. 3*d* is considered with FIGS. 3*a–c*. FIG. 3*d* indicates the approximate cross-section of the channel 13 for each of FIGS. 3*a–c*.

Figure 4:
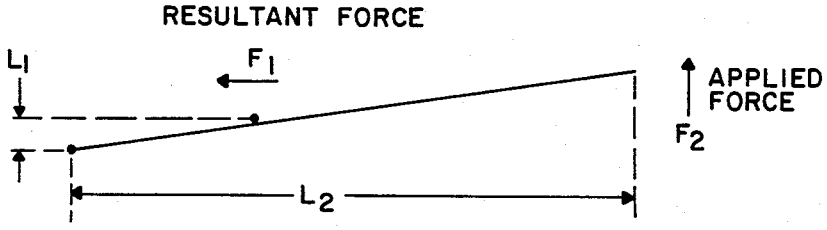
FIG. 4 is a force diagram of the quick release interconnection mechanism according to the invention.

FIG. 4 shows a force diagram of the lever arm 27A. A force F2 applied by a human hand results in a force F1 at the aligning pin 37A. As noted before, the force required at the aligning pin 37A is approximately 100 pounds, therefore the desired value for F1 is 100 pounds. The dimensions $L_1$ and $L_2$ respectively are the vertical and horizontal effective lever arms for the locking mechanism of the invention. The force F2 is applied at the knob 29 of lever arm 27A. The fulcrum of the force multipling lever arm is the shaft 19. The force F1 is applied at the interface of the aligning pins 37A and 37B and camming surface 43 of lever arms 27A and 27B. From the values for $L_2$ and $L_1$ given in FIG. 4 an applied force of F2 need be only approximately 11 pounds.

Therefore, this invention assures easy and quick connecting and disconnecting of a wave guide assembly and a down converter module from the front of radio transceiver housing. The connecting mechanism guarantees the necessary applied force at the waveguide - down converter interface which ensures good electrical and mechanical connection. The invention gives front housing access to servicing the down converter module 33 without sacrificing performance characteristics or reliability at the wave guide mechanism - down converter module interface. The connection mechanism of the invention actually improves the quality of the interface by guaranteeing a reliable self-aligning connection every time.

I claim:

1. A mechanism for holding in locked, force multiplied engagement within a housing a communications module assembly and a waveguide assembly, said mechanism comprising:

first and second lever arms having first and second ends, a mounting bracket secured to the housing and a pivot shaft having first and second ends secured to said mounting bracket, said first end of said first lever arm mounted on said first end of said pivot shaft, said first end of said second lever arm mounted on said second end of said pivot shaft, locking means coupled to said first lever arm second end, a channel in said housing for slidably retaining said locking means in the housing and allowing said locking means to move between first and second positions, camming surfaces on said first and said second lever arms that are more proximate to said first end than to said second end of said first and second lever arms, and aligning pins mounted on the communications module assembly and engaging said camming surface on said first and said second lever arms when said locking means is moved from said first position to said second position, whereby movement of said locking means from its first position to its second position causes said aligning pins to force the communications module assembly into a force multiplied engagement with the waveguide assembly.

2. A mechanism for holding in locked, force multiplied engagement within a housing a down converter module and a waveguide assembly, said mechanism comprising;

first and second lever arms having first and second ends, a pivot shaft having a first and second end, at least two aligning pins mounted on the down converter module, a mounting bracket securing said pivot shaft in a substantially horizontal plane, said first end of said first lever arm mounted on said first end of said pivot shaft, said first end of said second lever arm mounted on said second end of said pivot shaft, locking means coupled to said second end of said first lever arm, a channel for slidably retaining said locking means in the housing to allow said locking means to move between a disengaged position or a engaged position, a camming surface located on said first and second lever arm, said camming surface on said first lever arm being more proximate to said first end of said first lever arm than to said first lever arm second end, whereby movement of said locking means from said disengaged position to said engaged position causes said first and second lever arms to engage said at least two aligning pins at said first and second lever arms camming surfaces to force the down converter module into a force multiplied engagement with the waveguide assembly.

3. A mechanism according to claim 2 with said locking means having;

a first and second cylindrical neck portions of different diameters and aligned on a common axis, said channel defining an arc-shaped slot in said housing and having a first width at its central portion and a second greater width at the two ends of said channel, said diameter of said first cylindrical neck portion being less than said first width of said channel central portion, said diameter of said second cylindrical neck portion being greater than said first width of said channel central portion, said second width of said channel ends being greater than both said diameter of said first and second cylindrical neck portion, said first lever arm being flexible so as to allow movement of said first and second cylindrical neck portions in a direction parallel to said first and second neck portion common axis, whereby to lock said first lever arm in its disengaged or engaged position, said first and second cylindrical neck portions are pulled through said channel ends so that said second cylindrical neck portion rests within said channel ends to prevent said locking means from moving between its engaged position and its disengaged position.

4. A method for placing a communication module assembly and waveguide assembly in a force multiplied engagement within a housing by means of first and second lever arms having a pivot at a first end and locking means coupled to the first lever arm second end and interacting with a housing channel to lock the first lever arm in a first and a second position, and the communication module assembly having aligning pins which interfere with the travel of the lever arm about its pivot end, the method including the steps of:

(1) moving said communications module assembly flush against said waveguide assembly, (2) moving said first lever arm and said locking means within said housing channel from a first position toward a second position causing the lever arm to meet the aligning pins of the communication module assembly at a point proximate to said pivot end of said lever arms and camming the communications module assembly into a forced engagement with said waveguide assembly by completing the movement of said lever arm to its second position, and (3) locking said first lever arm in its second position with said locking means.

* * * * *